US008806684B1

(12) United States Patent
Ortega et al.

(10) Patent No.: US 8,806,684 B1
(45) Date of Patent: Aug. 19, 2014

(54) PILLOW DEVICE

(71) Applicants: Sandra E. Ortega, Enid, OK (US); Douglas J. Wade, Enid, OK (US)

(72) Inventors: Sandra E. Ortega, Enid, OK (US); Douglas J. Wade, Enid, OK (US)

( * ) Notice: Subject to any disclaimer, the term of this patent is extended or adjusted under 35 U.S.C. 154(b) by 0 days.

(21) Appl. No.: 14/227,646

(22) Filed: Mar. 27, 2014

Related U.S. Application Data

(63) Continuation-in-part of application No. 14/019,643, filed on Sep. 6, 2013, now Pat. No. 8,756,734.

(51) Int. Cl.
*A47G 9/10* (2006.01)

(52) U.S. Cl.
CPC ..... *A47G 9/10* (2013.01)
USPC ..... 5/636; 5/632; 5/646

(58) Field of Classification Search
USPC ..... 5/636, 632, 630, 638, 646; D6/601
See application file for complete search history.

(56) References Cited

U.S. PATENT DOCUMENTS

| | | | | | |
|---|---|---|---|---|---|
| 941,043 | A | * | 11/1909 | Powell | 5/640 |
| 1,386,652 | A | * | 8/1921 | Patton | 5/640 |
| 2,295,906 | A | * | 9/1942 | Lacour | 5/636 |
| 2,562,725 | A | * | 7/1951 | Leto et al. | 5/631 |
| 2,765,480 | A | * | 10/1956 | Mueller | 5/640 |
| 2,782,427 | A | | 2/1957 | Ericson | |
| 3,555,582 | A | | 1/1971 | Radford | |
| 3,757,365 | A | * | 9/1973 | Kretchmer | 5/636 |
| 4,074,376 | A | * | 2/1978 | Bond | 5/632 |
| 4,118,813 | A | * | 10/1978 | Armstrong | 5/638 |
| D250,985 | S | * | 2/1979 | Armstrong | D6/601 |
| 4,506,396 | A | * | 3/1985 | Ritchie et al. | 5/631 |
| 4,528,705 | A | * | 7/1985 | Greenawalt | 5/644 |
| 4,821,355 | A | * | 4/1989 | Burkhardt | 5/636 |
| 4,876,755 | A | * | 10/1989 | Parrish | 297/284.3 |
| D318,203 | S | * | 7/1991 | Zaghini | D6/601 |
| 5,054,143 | A | | 10/1991 | Javaher | |
| 5,479,667 | A | | 1/1996 | Nelson et al. | |
| 5,499,418 | A | * | 3/1996 | Tan et al. | 5/655 |
| D381,233 | S | * | 7/1997 | Torbik | D6/601 |
| D388,648 | S | * | 1/1998 | Bates | D6/601 |
| D389,359 | S | * | 1/1998 | Nowak | D6/601 |
| 5,708,998 | A | * | 1/1998 | Torbik | 5/636 |
| 5,906,205 | A | | 5/1999 | Hiebert | |
| 5,937,461 | A | * | 8/1999 | Dombrowski et al. | 5/655 |
| 6,050,265 | A | * | 4/2000 | Richardson | 128/845 |
| 6,065,166 | A | | 5/2000 | Sharrock et al. | |
| 6,795,990 | B1 | * | 9/2004 | Hutchinson | 5/632 |
| D553,412 | S | * | 10/2007 | Cupo | D6/601 |
| 7,316,041 | B2 | * | 1/2008 | Guez | 5/636 |
| D561,511 | S | | 2/2008 | Peart | |
| 7,516,504 | B2 | * | 4/2009 | Guez | 5/636 |
| 7,634,829 | B1 | * | 12/2009 | La Bar | 5/632 |
| 7,861,720 | B1 | | 1/2011 | Wolcott | |
| 7,908,691 | B2 | | 3/2011 | Small | |
| D639,101 | S | * | 6/2011 | Kalatsky | D6/601 |

(Continued)

*Primary Examiner* — Robert G Santos

(57) ABSTRACT

A pillow device for supporting a person's head without compression of nerves or arteries includes a main section having a top surface, a bottom surface, and a perimeter edge coupled to and extending between the top surface and the bottom surface. A projection extends from the perimeter edge of the main section. The projection is substantially T-shaped having a distal section relative to the main section and a connection section coupled to and extending between the distal section and the perimeter edge. Each of a pair of opposed end sections of the distal section of the projection is configured for positioning under an arm of a user when a head of the user is supported by the main section.

16 Claims, 3 Drawing Sheets

(56) References Cited

U.S. PATENT DOCUMENTS

| | | | | |
|---|---|---|---|---|
| 8,065,766 | B1 | 11/2011 | Fierro | |
| 8,069,515 | B1 | 12/2011 | Tingey | |
| 8,291,534 | B2 | 10/2012 | Karlson | |
| D690,535 | S * | 10/2013 | Huang | D6/601 |
| 2007/0006382 | A1 * | 1/2007 | Guez | 5/638 |
| 2008/0092296 | A1 * | 4/2008 | Guez | 5/636 |
| 2008/0134437 | A1 | 6/2008 | Small | |
| 2011/0296615 | A1 | 12/2011 | Tingey | |
| 2012/0144591 | A1 | 6/2012 | Mobley et al. | |
| 2012/0174320 | A1 | 7/2012 | White et al. | |

* cited by examiner

PILLOW DEVICE

CROSS-REFERENCE TO RELATED APPLICATIONS

This application is a continuation in part of pending application Ser. No. 14/019,643, filed Sep. 6, 2013.

BACKGROUND OF THE DISCLOSURE

Field of the Disclosure

The disclosure relates to pillow devices and more particularly pertains to a new pillow device for supporting a person's head without compression of nerves or arteries.

SUMMARY OF THE DISCLOSURE

An embodiment of the disclosure meets the needs presented above by generally comprising a main section having a top surface, a bottom surface, and a perimeter edge coupled to and extending between the top surface and the bottom surface. A projection extends from the perimeter edge of the main section. The projection is substantially T-shaped having a distal section relative to the main section and a connection section coupled to and extending between the distal section and the perimeter edge. Each of a pair of opposed end sections of the distal section of the projection is configured for positioning under an arm of a user when a head of the user is supported by the main section.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
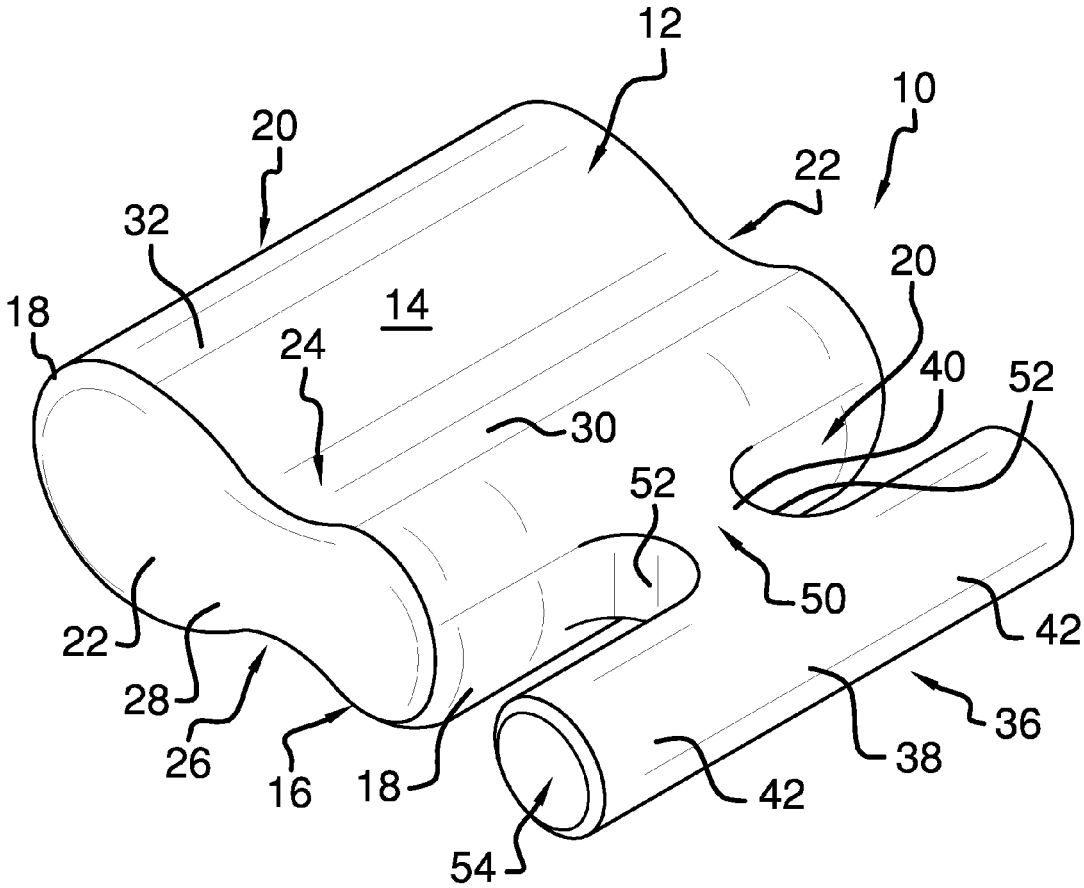
FIG. 1 is a top front side perspective view of a pillow device according to an embodiment of the disclosure.
Figure 2:
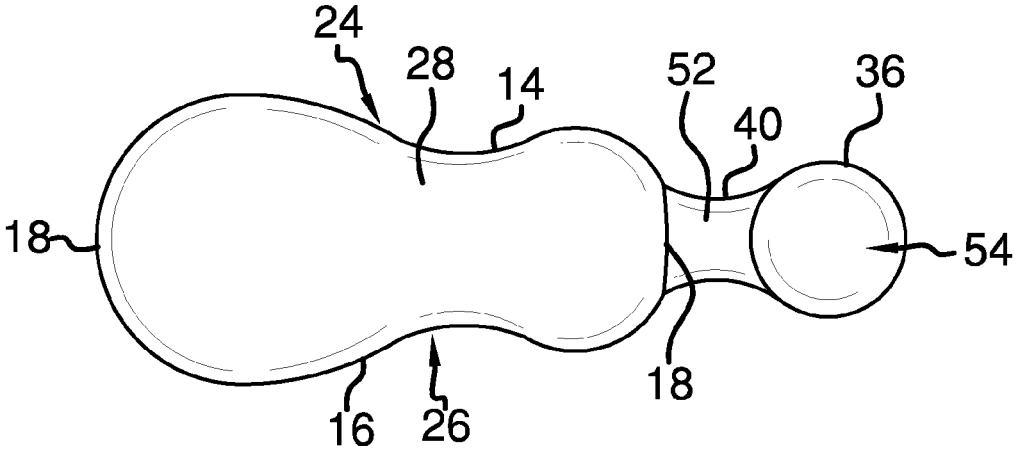
FIG. 2 is a side view of an embodiment of the disclosure.
Figure 3:
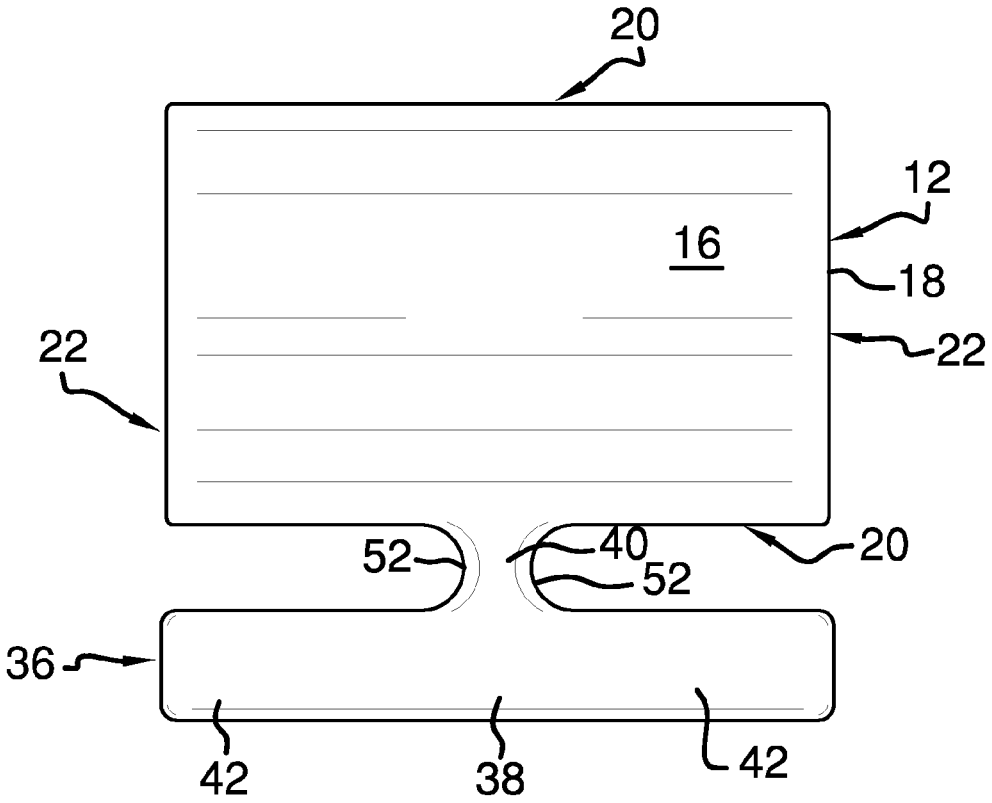
FIG. 3 is a bottom view of an embodiment of the disclosure.
Figure 4:
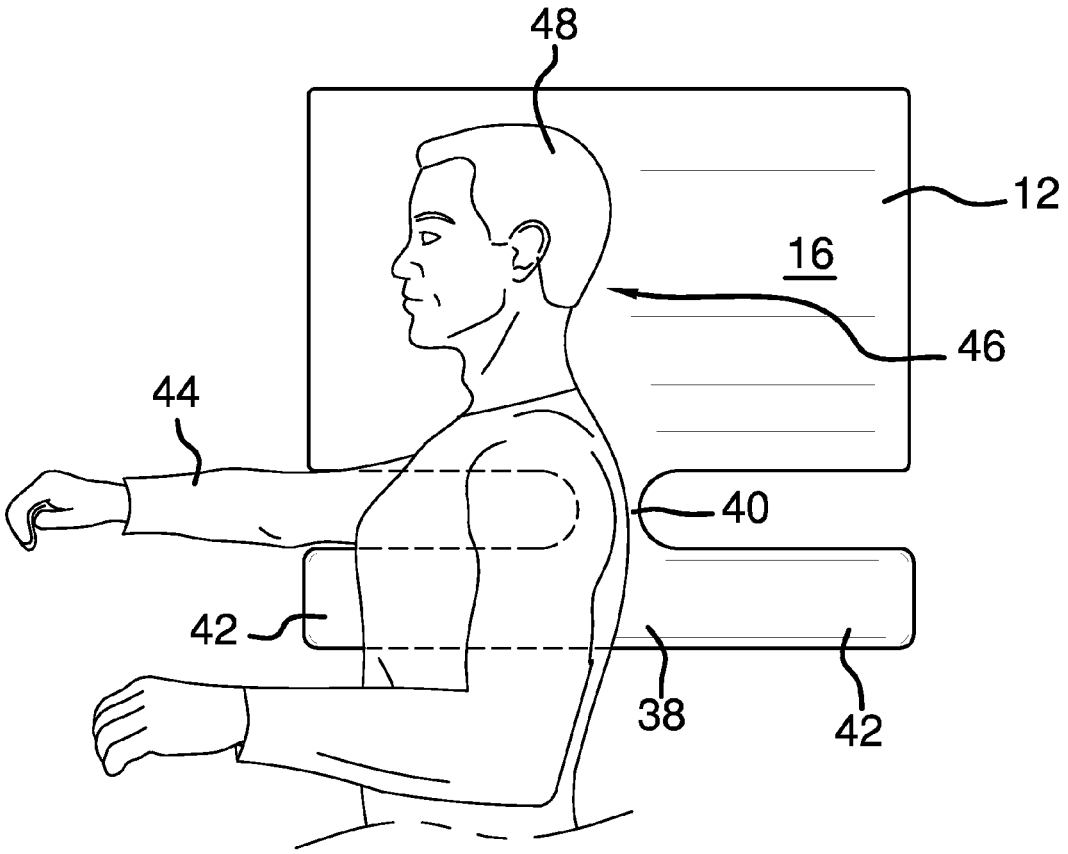
FIG. 4 is a top view of an embodiment of the disclosure in use.

With reference now to the drawings, and in particular to FIGS. 1 through 4 thereof, a new pillow device embodying the principles and concepts of an embodiment of the disclosure and generally designated by the reference numeral 10 will be described.

As best illustrated in FIGS. 1 through 4, the pillow device 10 generally comprises a main section 12 having a top surface

14, a bottom surface 16, and a perimeter edge 18 coupled to and extending between the top surface 14 and the bottom surface 16. The perimeter edge 18 of the main section 12 is substantially rectangular. The perimeter edge 18 has a pair of longitudinal sides 20 extending between opposed end sides 22. The top surface 14 of the main section 12 is undulated defining a lateral depression 24 extending across the top surface 14 of the main section 12 between the opposed end sides 22. Similarly, the bottom surface 16 of the main section 12 is undulated defining a lateral channel 26 extending across the bottom surface 16 of the main section 12 between the opposed end sides 22. The lateral depression 24 is aligned with the lateral channel 26 defining a neck 28 extending across the main section 12 between a first bulbous portion 30 of the main section 12 and a second bulbous portion 32 of the main section 12.

The second bulbous portion 32 of the main section 12 has a maximum width between the top surface 14 and the bottom surface 16 greater than a maximum width of the first bulbous portion 30 of the main section 12 between the top surface 14 and the bottom surface 16 of the main section 12. The maximum width of the first bulbous portion 30 is between 9 and 18 centimeters while the maximum width of the second bulbous portion 32 is between 10 and 22 centimeters. A minimum width of the neck 28 between the top surface 14 of the main section 12 and the bottom surface 16 of the main section 12 is between 7 and 13 centimeters.

A projection 36 extends from the perimeter edge 18 of the main section 12. The projection 36 is substantially T-shaped having a distal section 38 relative to the main section 12 and a connection section 40 coupled to and extending between the distal section 38 and the perimeter edge 18 wherein each of a pair of opposed end sections 42 of the distal section 38 of the projection 36 is configured for positioning under an arm 44 of a user 46 when a head 48 of the user 46 is supported by the main section 12. The connection section 40 extends from one of the longitudinal sides 20. More particularly, the connection section 40 may extend from the perimeter edge 18 proximate a center 50 between the opposed end sides 22 wherein each opposed end section 42 extends outwardly towards an associated one of the end sides 22 from the center 50. The projection 36 extends from the first bulbous portion 30 of the main section 12. The connection section 40 of the projection 36 has concave side faces 52 extending from the perimeter edge 18 of the main section 12. A minimum width between the concave side faces 52 of the connection section 40 measured at the thickest width of the connection section 40 is between 7 and 16 centimeters. The distal section 38 of the projection 36 is substantially cylindrical and has a substantially circular cross-sectional shape 54 transverse to a longitudinal axis of the distal section 38. A diameter of the distal section 38 of the projection 36 is between 7 and 21 centimeters. The distal section 38 of the projection 36 is substantially parallel to the main section 12. The distal section 38 of the projection 36 is spaced from the main section 12 between 12 and 21 centimeters. A length of the main section 12 may be equal to a length of the distal section 38 of the projection 36. The device 10 may be a unitary piece of a resilient foam, memory foam, or another material conventionally used in pillows.

In use, the main section 12 of the device 10 is used to support the head 48 allowing the arm 44 of the user 46 to be positioned extending between the distal section 38 and the main section 12. The device 10 is substantially symmetrical to either side of the connection section 40 allowing the user 44 to select a comfortable position facing either direction without having to substantially reposition or flip the device 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A pillow device comprising:

a main section having a top surface, a bottom surface, and a perimeter edge coupled to and extending between said top surface and said bottom surface, said perimeter edge having a pair of longitudinal sides extending between opposed end sides;

a projection extending from said perimeter edge of said main section, said projection being substantially T-shaped having a distal section relative to said main section and a connection section coupled to and extending between said distal section and said perimeter edge wherein each of a pair of opposed end sections of said distal section of said projection is configured for positioning under an arm of a user when a head of the user is supported by said main section;

said top surface of said main section being undulated defining a lateral depression extending across said top surface of said main section between said opposed end sides;

said distal section of said projection being substantially cylindrical and having a substantially circular cross-sectional shape transverse to a longitudinal axis of said distal section;

and a length of said main section being equal to a length of said distal section of said projection.

2. The device of claim 1, further comprising said perimeter edge of said main section being substantially rectangular.

3. The device of claim 1, further comprising said connection section extending from one of said longitudinal sides.

4. The device of claim 3, further comprising said connection section extending from said perimeter edge proximate a center between said opposed end sides wherein each said opposed end section extends outwardly towards an associated one of said end sides from said center.

5. The device of claim 1, further comprising said bottom surface of said main section being undulated defining a lateral channel extending across said bottom surface of said main section between said opposed end sides.

6. The device of claim 1, further comprising said lateral depression being aligned with said lateral channel defining a neck extending across said main section between a first bulbous portion of said main section and a second bulbous portion of said main section.

7. The device of claim 6, further comprising:

said projection extending from said first bulbous portion of said main section; and said second bulbous portion of said main section having a maximum width between said top surface and said bottom surface greater than a maximum width of said first bulbous portion of said main section between said top surface and said bottom surface of said main section.

8. The device of claim 7, further comprising said maximum width of said second bulbous portion being between 10 and 22 centimeters.

9. The device of claim 7, further comprising said maximum width of said first bulbous portion being between 9 and 18 centimeters.

10. The device of claim 6, further comprising a minimum width of said neck between said top surface of said main section and said bottom surface of said main section being between 7 and 13 centimeters.

11. The device of claim 1, further comprising said connection section of said projection having concave side faces extending from said perimeter edge of said main section.

12. The device of claim 11, further comprising a minimum width between said concave side faces of said connection section being between 7 and 16 centimeters.

13. The device of claim 1, further comprising a diameter of said distal section of said projection being between 7 and 21 centimeters.

14. The device of claim 1, further comprising said distal section of said projection being substantially parallel to said main section.

15. The device of claim 14, further comprising said distal section of said projection being spaced from said main section between 12 and 21 centimeters.

16. A pillow device comprising:

a main section having a top surface, a bottom surface, and a perimeter edge coupled to and extending between said top surface and said bottom surface, said perimeter edge of said main section being substantially rectangular, said perimeter edge having a pair of longitudinal sides extending between opposed end sides, said top surface of said main section being undulated defining a lateral depression extending across said top surface of said main section between said opposed end sides, said bottom surface of said main section being undulated defining a lateral channel extending across said bottom surface of said main section between said opposed end sides, said lateral depression being aligned with said lateral channel defining a neck extending across said main section between a first bulbous portion of said main section and a second bulbous portion of said main section, said second bulbous portion of said main section having a maximum width between said top surface and said bottom surface greater than a maximum width of said first bulbous portion of said main section between said top surface and said bottom surface of said main section, said maximum width of said first bulbous portion being between 9 and 18 centimeters, said maximum width of said second bulbous portion being between 10 and 22 centimeters, a minimum width of said neck between said top surface of said main section and said bottom surface of said main section being between 7 and 13 centimeters;

a projection extending from said perimeter edge of said main section, said projection being substantially T-shaped having a distal section relative to said main section and a connection section coupled to and extending between said distal section and said perimeter edge wherein each of a pair of opposed end sections of said distal section of said projection is configured for positioning under an arm of a user when a head of the user is supported by said main section, said connection section extending from one of said longitudinal sides, said connection section extending from said perimeter edge proximate a center between said opposed end sides wherein each said opposed end section extends outwardly towards an associated one of said end sides from said center, said projection extending from said first bulbous portion of said main section, said connection section of said projection having concave side faces extending from said perimeter edge of said main section, a minimum width between said concave side faces of said connection section being between 7 and 16 centimeters, said distal section of said projection being substantially cylindrical and having a substantially circular cross-sectional shape transverse to a longitudinal axis of said distal section, a diameter of said distal section of said projection being between 7 and 21 centimeters, said distal section of said projection being substantially parallel to said main section, said distal section of said projection being spaced from said main section between 12 and 21 centimeters; and a length of said main section being equal to a length of said distal section of said projection.

* * * * *